US006817127B2

(12) United States Patent
Gottlieb et al.

(10) Patent No.: US 6,817,127 B2
(45) Date of Patent: Nov. 16, 2004

(54) MOVABLE ADVERTISING DISPLAY SYSTEM AND METHOD

(75) Inventors: Thomas Gottlieb, Des Peres, MO (US); Gregory Litwicki, Ellisville, MO (US)

(73) Assignee: Anheuser-Busch, Inc., St. Louis, MO (US)

( * ) Notice: Subject to any disclaimer, the term of this patent is extended or adjusted under 35 U.S.C. 154(b) by 10 days.

(21) Appl. No.: 10/295,975

(22) Filed: Nov. 15, 2002

(65) Prior Publication Data

US 2004/0093772 A1 May 20, 2004

(51) Int. Cl.[7] ..... G09F 1/00; G09F 3/00

(52) U.S. Cl. ..... 40/661.03; 40/661.09; 40/584

(58) Field of Search ..... 40/661.03, 584, 40/661.09; D20/23

(56) References Cited

U.S. PATENT DOCUMENTS 2,130,945 A * 9/1938 Brownell ..... 40/659
2,923,078 A * 2/1960 Slavsky ..... 40/661.03
3,753,305 A * 8/1973 Mueh ..... 40/649
3,774,328 A * 11/1973 Tanney ..... 40/661.09
4,167,073 A * 9/1979 Tang ..... 40/661.03
4,723,745 A * 2/1988 Conway ..... 248/205.3
5,042,768 A * 8/1991 Goldstein ..... 248/223.41

* cited by examiner

*Primary Examiner*—Cassandra Davis
(74) *Attorney, Agent, or Firm*—Dawn C. Wolff; Storm & Hemingway LLP

(57) ABSTRACT

A movable advertising system and method that can be produced inexpensively in a wide variety of shapes, colors, and sizes and easily installed in consumer purchasing locations. The movable advertising system is designed to attract the attention of the purchasing public and enhance the sales of advertised product. The unique feature of the system is a self-contained support mechanism that reinforces the system and provides sufficient support to enable the advertising system to carry a tear-pad for sweepstakes, coupons, and/or other consumer offers.

12 Claims, 1 Drawing Sheet

MOVABLE ADVERTISING DISPLAY SYSTEM AND METHOD

BACKGROUND

Advertisements designed to attract the attention of the purchasing public and enhance the sales of advertised product exist in a wide variety of shapes, colors and sizes. Over time, as the public becomes inundated with more advertising, a continuing search has been directed to the development of new advertising methods that can attract the attention of the public and enhance sales and/or product awareness. It is known that movement will attract the human eye, and thus there has been a market in advertising display systems that move as a method of gaining attention of the public. However, typically, devices that enable movement of the attached advertisement have been bulky, expensive, difficult to install, and often difficult to move or change. Devices such as coupon-dispensing devices attract the consumer eye by projecting outwards from a storage device, such as a cooler door, and dispensing coupons or sweepstakes entries that the consumer can then withdraw from the device. However, each dispenser requires a motorized mechanism that is costly, and while is in theory reusable, generally is removed or damaged such that reuse is not possible. Lightweight advertisements designed to move with movement of atmospheric air are generally inexpensive, but generally have a limitation as to size and/or or weight that can be supported by the system while still providing movement sufficient to attract the eye of the purchasing public.

Thus, the need has arisen for systems and methods for implementing a movable advertising display system that is inexpensive, simple, reasonably sized, self-contained, that can support sufficient weight to provide a tear-pad containing multiple documents that consumers can remove for their use, such as a coupon or sweepstakes entry, and can be used in a variety of forms in a variety of locations to attain customer attention and includes all instructions necessary to install and implement the system. This is particularly true for advertising displays that are to be used for short durations of time, such as those containing entries for contests, or advertisements that relate to a particular holiday season or sports season, or price reduction coupons good for a limited period of time, where products that are expensive or require large amounts of time to install are not appropriate for the short time duration the product will have a useful life.

SUMMARY

Accordingly, the system of the present invention comprises an advertising system and method that is inexpensive, easy to install, provides for a simple and inexpensive method of providing movement of the advertisement to attain customer attention, and can be produced in a wide variety of sizes, shapes, colors, and weights as appropriate to the product being advertised. In particular, the system of the present invention, if attached to a door or price rail of cooler vault or shelf system, will move with movement of the ambient air. This type of movement is such that the notice of the public will be gained. This is particularly true when the goods are stored behind a door, such as a cooler door. When the door is opened to attain access to goods, the advertising system will move asynchronously with the movement of the door, such movement catching the eye of the purchasing public. This is an improvement over a fixed advertising system, such as a sticker affixed to the door that moves with the door.

Significantly, the present invention uniquely provides a method of offering removable data sheets, such as discount coupons or contest entry forms that interested members of the public can remove and carry away with them, while providing a sufficient support system to retain the advertising system at the attachment point while still providing the ability for the system to move in relation to the attachment point such as to attract the attention of the consuming public without the need for a motorized or computerized or other type dispensing system that is expensive.

The present invention, an apparatus for displaying advertising information, comprises a first, or head, portion on which advertising information can be displayed; a third, or support plate portion, that provides adequate strength and size to support the apparatus, and provide means for affixing the apparatus to an object such as a door or in the rail on the front of a store shelving system or cooler door; and a second, or arm portion, connecting the support plate and the head portion that is of a sufficient size and weight to support the first portion while being flexible enough to enable the head portion to move on the arm portion in response to an external force. This self-contained support mechanism provides for a flexible system that moves and additionally can support enough weight to allow for use of a tear-pad on the head portion of the apparatus.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
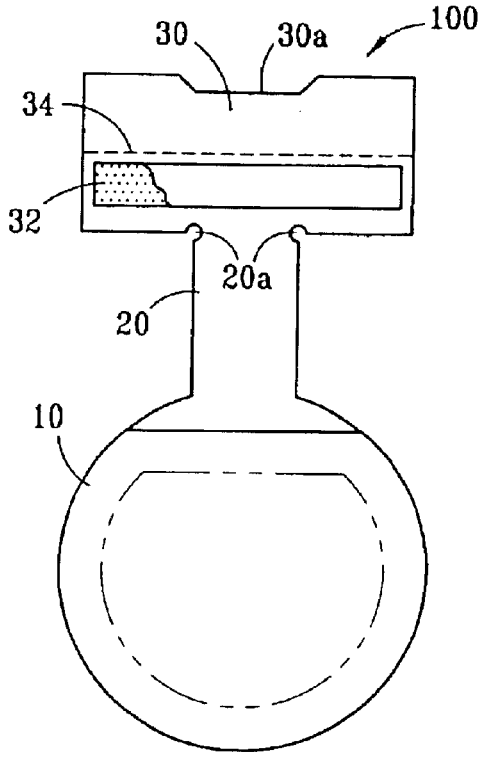
FIG. 1 is a plan view of one arrangement of an advertising system of the present invention.

In the discussion of the FIGURES the same reference numerals will be used throughout to refer to the same or similar components. In the interest of conciseness, various other components known to the art, such as commercial shelving and storage systems and commercial cooler mechanisms have not been shown or discussed. In the following discussion, numerous specific details are set forth to provide a thorough understanding of the present invention. However, it will be obvious to those skilled in the art that the present invention may be practiced without such specific details.

Refer now to the drawings wherein depicted elements are, for the sake of clarity, not necessarily shown to scale and wherein like or similar elements are designated by the same reference numeral through the several views.

Referring to FIG. 1 of the drawings, the reference numeral 100 generally designates an advertising system embodying features of the present invention. The system 100 includes a cut and shaped mechanism comprising a first or head portion 10, a second or arm portion 20, and a third or support plate portion 30. The head portion 10 of the advertising system 100 can be cut in a variety of shapes. The arm portion 20 perpendicularly connects the head portion 10 and the support plate portion 30. The arm portion 20 and support plate portion 30 are of a size and shape that they provide sufficient support to the head portion 10 of the advertising system 100 such that when the head portion 10 has multiple copies of advertising media 12 attached, the arm portion 20 will maintain an arcuate shape such that the head portion 10 will be able to move with movement of the ambient air.

Figure 2:
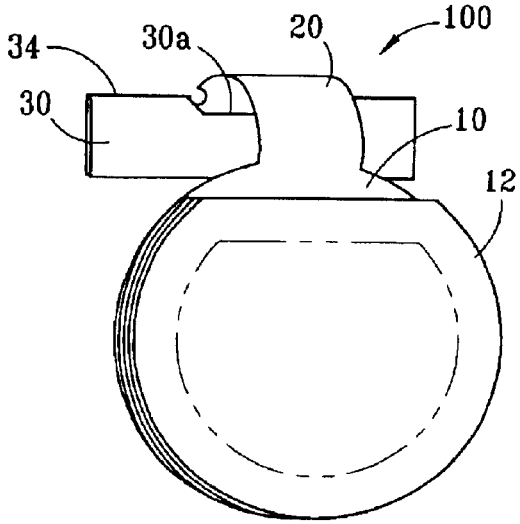
FIG. 2 is a perspective view of one arrangement of an advertising mechanism of the present invention in which the advertising mechanism is adhesively secured to an object.

In a preferred arrangement of the advertising system 100, the support plate portion 30 is perforated 34 across the width such that it can be easily folded. In use, the support plate portion 30 is folded along the perforation, as shown in FIG. 2. This arrangement enables text, pictures or advertising to be printed on the part of the support plate portion 30 above the perforation such that, the printed advertising will display outwardly when the advertising system 100 is installed. This enables printing of the advertising system 100 on a single side, reducing printing costs while increasing advertising display area. If it is desired, however, information for use by the advertiser or installer of the advertising system 100, such as installation instructions, can be printed on the obverse side of the advertising system 100.

As can be clearly seen in FIG. 1, in one arrangement of the advertising system 100, the edge of the support plate portion 30 that is opposite the attachment point of the arm portion 20 has a small cut-out portion 30*a* along the upper edge. In this arrangement, the support plate portion 30 is of a size and shape such that when the support plate portion 30 is folded along the perforation 34 it is capable of being inserted into a price rail of a cooler vault or shelf system. When it is detached along the perforation 34, the support plate portion 30 can be slid into commercially available shelving system or cooler vault price rails, and the detached portion can be inserted on top of the support plate portion 30 still attached to the advertising system 100. Alternatively, the support plate portion 30 can be folded along the perforation 34 and the folded support plate portion 30 can be slid into shelving or cooler price rails. In either arrangement, the dual support plate provides greater support for the advertising system necessary to support a head portion 10 having multiple advertising media 12 attached thereto while still maintaining an arcuate shape to the arm portion 20 such that the head portion 10 will be able to move with movement of the ambient air. Another alternative is to use the detached portion of the support plate 30 as a separate advertising mechanism apart from the remainder of the advertising system 100. The detached portion can be used by attaching or inserting it elsewhere, such as to a rail system inside a cooler.

Optionally, a commercially available adhesive 32 can be applied to the part of the support plate portion 30 between the perforation 34 and the arm portion 20. Additional support for the advertising system 100 can be obtained by removing the protective cover from the adhesive 32 so the adhesive 32 can adhere to the rail or other mounting surface. This greater support, alone or in combination with the increased support provided by the two layers of support plate portion 30 enables a tear-pad of multiple advertising media 12 to be affixed to the head portion 10.

As can be clearly seen in FIG. 1, in addition to the cut-out 30*a* along the upper edge of the support plate portion 30, the connection point of the support plate 30 to the arm portion 20 has notches 20*a* at the base of the arm portion 20. These cutouts 30*a* and notches 20*a* function such that the arm portion 20 can be hung forward form an arcuate shape such that the head portion 10 of the advertising system can move on the arm portion 20 without the arm portion 20 or upper portion of the support plate 30 binding on the top lip of a shelving rail system. Additionally, the arm portion 20 of the present invention is of a larger size than the arm of prior art advertising systems. This greater width provides additional support for the head portion 10 containing multiple advertising media 12, but is still of a size to allow the arm portion 20 to form an arcuate shape that enables the head portion 10 to move with movement of the ambient air. The cutout 30*a* on the support plate portion 30 and the notches 20*a* at the base of the arm portion 20 also relieve tension and stress on the arm portion 20 and the support plate 30 due to the weight of the head portion 10, and ensure the arm portion 20 does not rip or tear at the point of attachment to the head portion 10.

The advertising system 100 can be made of a variety of materials, including one or more of paper, cardboard, plastic and other materials. The materials should be of a sufficient thickness such that when installed, the support plate portion 30 and arm portion 20 will provide sufficient support for the head 10 portion, and any multiple advertising media 12 affixed to the head portion 10, with the head portion being flexibly attached to the arm portion 20, such that the arm portion 20 will form an arcuate shape that will enable the head portion 10 of the advertising mechanism 100 to hang suspended and move slightly with movement of the device to which the advertising mechanism 100 is attached, or when the head portion 10 or arm portion 20 are moved by an outside force, as shown in FIG. 2.

In one arrangement of the advertising system 100, as shown in FIG. 2, it may be desirable to attach copies of advertising media 12 to the head portion 10. Typically, the head portion will have affixed thereto a tear-pad that contains multiple removable copies of advertising media 12, such as coupons or sweepstakes entries, so that members of the purchasing public can remove a copy of the desired information. This is particularly useful in providing sweepstake entry forms, coupons, or other information 12 that can be removed by members of the purchasing public. This is especially useful in that the advertising system 100 can be mounted to the desired surface, enabling members of the purchasing public to readily see the advertisement on the advertising system, remove a copy of the document, if desired, and still provide a surface on the head portion 10 for advertising when all the removable copies of the advertising documents 12 have been detached.

This system and method serves the multiple purposes of making the advertising document visible to the purchasing public, enabling copies of documents to be easily removed while keeping unused copies of the document securely attached to the advertising system, and providing an inexpensive mechanism to make such advertisements. The size and material strength of the support plate portion 30 and arm portion 20 must provide adequate support for the extra weight of the documents 12 attached to the advertising system 100, while still ensuring the arm portion 20 maintains an arcuate shape enabling the head portion 10 to move on the end of the arm portion 20. This support is also achieved by means of the cutout 30*a* on the upper edge of the support plate portion 30 and the notches 20*a* at the point of attachment of the arm portion 20 to the support plate portion 30, which provides stress relief and reduces problems of the arm portion 20 tearing away from the support plate portion 30 owing to the weight of the head portion 10. In some situations, it may be necessary to provide additional support material to the head portion 10 to ensure the system shape and movement are properly maintained and balanced. The unique feature of this advertising system 100 is that it is constructed such that this balance is maintained and the advertising system 100 functions as intended while providing multiple removable advertising documents 12 that can be taken by the purchasing public without the need for costly motorized or computerized devices to dispense the documents as used in other advertising systems.

Figure 3:
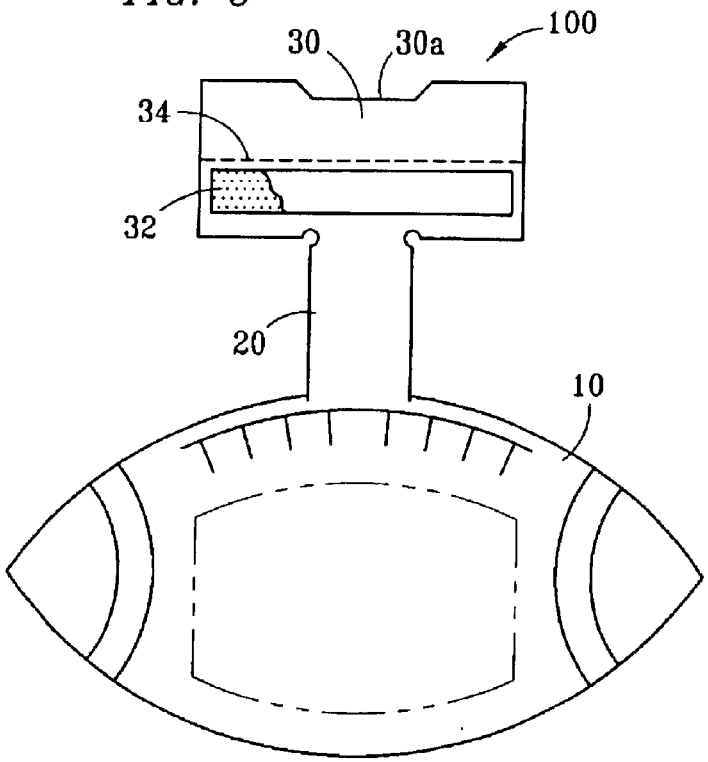
FIG. 3 is a perspective view of one arrangement of an advertising mechanism of the present invention in which a portion of the advertising mechanism is made in a shape that resembles a familiar object, such as in this case a football.

FIG. 3 depicts an advertising system 100 in which the head portion 10 is shaped to depict a seasonally appropriate device, such as in this case a football. It is understood that the head portion 10 can be shaped to resemble a variety of seasonal devices, such as footballs, hearts, shamrocks, stars and the like, or the seasonal representation can be achieved through printed depiction on the head portion 10, such as a round head portion 10 being colored to represent a baseball, basketball, hockey puck and the like.

It is understood that the present invention can take many forms and embodiments. Accordingly, several variations may be made in the foregoing without departing from the spirit or the scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments.

What is claimed is:

1. An apparatus for displaying advertising information, the apparatus comprising:

a) a head portion;

b) a support plate portion perforated across its width that provides a self-contained support mechanism for the apparatus, having a means for affixing the apparatus to a surface;

c) an arm portion that flexibly connects the support plate portion to the head portion of a sufficient size and weight to support the head portion, while enabling the head portion to move on the arm portion in response to an external force; and d) information displayed on at least one of the head portion, support plate portion or arm portion.

2. A The apparatus of claim 1 wherein the support plate portion is of a size and shape to enable insertion of the support plate portion into a price rail of a commercially available cooler or shelf system when the support plate portion is torn along the perforation, the detached support plate portion further having a cut-out along the upper edge where the detached support plate portion contacts the arm portion when the detached support plate portion is inserted into the rail on top of and aligned with the non-detached portion of the support plate.

3. The apparatus of claim 1 wherein the support plate portion is of a size and shape to enable insertion of the support plate portion into a rail of a shelf system when the support plate portion is torn along the perforation, the detached support plate portion being used separately from the rest of the apparatus.

4. The apparatus of claim 1 wherein the support plate portion is of a size and shape to enable insertion of the support plate portion into a rail of a shelf system when the support plate portion is folded along the perforation, the support plate portion further having a cut-out along the upper edge where the support plate portion contacts the arm portion when the folded support plate portion is inserted into the rail.

5. The apparatus of claim 1 wherein the support plate portion has an adhesive applied to a least a part of the support plate portion between the perforation and point of connection of the support plate portion to the arm portion for securing the apparatus to a surface.

6. The apparatus of claim 1 wherein the head portion is shaped to resemble an object.

7. A method of displaying advertising information comprising attaching to a surface an advertising display system consisting of at least a support plate portion perforated across the width, an arm portion, a head portion that is flexibly attached to the support plate portion by the arm portion, the advertising display system being cut from one or more materials, with information displayed on at least one of the head portion, support plate portion, or arm portion, the head portion moving on the arm portion in response to external stimuli.

8. The method of claim 7 further comprising folding the support plate portion of the advertising display system at the perforation to provide increased support to the advertising display system.

9. The method of claim 7 further comprising separating the support plate portion of the advertising display system at the perforation, inserting the advertising display system into the rail of a commercially available cooler or shelf system, and inserting the detached portion of the support plate portion into the rail on top of and aligned with the non-detached portion of the support plate such that a cut-out on the detached portion of the support plate contacts the arm portion when the detached support plate portion is inserted into the rail.

10. The method of claim 7 further comprising separating the support plate portion of the advertising display system at the perforation, inserting the advertising display system into the rail of a commercially available cooler or shelf system and using the detached portion of the support plate in a different location.

11. The method of claim 7 further comprising shaping the head portion to resemble an object.

12. The method of claim 7 wherein an adhesive is applied to at least part of the support plate for securing the advertising display system to the surface.

* * * * *

UNITED STATES PATENT AND TRADEMARK OFFICE

CERTIFICATE OF CORRECTION

PATENT NO. : 6,817,127 B2
DATED : November 16, 2004
INVENTOR(S) : Gottlieb et al.

It is certified that error appears in the above-identified patent and that said Letters Patent is hereby corrected as shown below:

Title page,
Item [56], References Cited, U.S. PATENT DOCUMENTS, please insert -- 6,276,724 B, issued 8/2001, to Zorn--.

Signed and Sealed this

First Day of February, 2005

JON W. DUDAS
*Director of the United States Patent and Trademark Office*